US006237168B1

(12) United States Patent
Daniel, III et al.

(10) Patent No.: US 6,237,168 B1
(45) Date of Patent: May 29, 2001

(54) SINK DRAIN ASSEMBLY INCLUDING SINK SEAL CAP REMOVAL TOOL

(75) Inventors: John H. Daniel, III, Strongsville; Allen L. Talley, Hudson, both of OH (US)

(73) Assignee: Moen Incorporated, North Olmsted, OH (US)

( * ) Notice: Subject to any disclaimer, the term of this patent is extended or adjusted under 35 U.S.C. 154(b) by 0 days.

(21) Appl. No.: 09/487,029

(22) Filed: Jan. 19, 2000

(51) Int. Cl.[7] ..... A47K 1/14; B25B 13/10; B25B 13/50

(52) U.S. Cl. ..... 4/661; 4/295; 4/689; 137/315.41; 81/176.15; 81/436

(58) Field of Search ..... 4/661, 679, 688, 4/689, 693, 295; 137/15.17, 15.18, 315.41, 327; 81/176.15, 176.3, 176.1, 436; 29/221.6

(56) References Cited

U.S. PATENT DOCUMENTS

| | | | | |
|---|---|---|---|---|
| 241,739 | | 5/1881 | Slow . | |
| 1,618,679 | | 2/1927 | Schifter . | |
| 2,043,088 | | 6/1936 | Zinkil et al. . | |
| 2,438,302 | | 3/1948 | Simcich . | |
| 3,742,525 | * | 7/1973 | Oropallo | 4/288 |
| 3,886,603 | | 6/1975 | Onesta | 4/295 X |
| 4,380,834 | | 4/1983 | Wentz . | |
| 4,932,082 | | 6/1990 | Ridgeway . | |
| 5,090,276 | * | 2/1992 | Groskey | 81/436 |
| 5,363,518 | | 11/1994 | Mowery | 4/688 X |
| 5,418,983 | | 5/1995 | Garguillo et al. . | |
| 5,592,701 | * | 1/1997 | Smith | 4/295 |
| 5,832,544 | | 11/1998 | Pan . | |
| 5,832,545 | | 11/1998 | Pan | 4/295 X |
| 5,946,990 | * | 9/1999 | Bonacci | 81/176.15 |

* cited by examiner

*Primary Examiner*—Gregory L. Huson
*Assistant Examiner*—Kathleen J. Prunner
(74) *Attorney, Agent, or Firm*—Cook, Alex, McFarron, Manzo, Cummings & Mehler, Ltd.

(57) ABSTRACT

A sink drain assembly includes a waste plug, a drain cap and a sink seal cap. The sink seal cap is formed and adapted to be attached to a sink drain conduit and to be mounted thereon in a sink drain opening. The waste plug and drain cap are detachably secured together so that the drain cap may be removably mounted on the waste plug and when so combined the waste plug and drain cap function to control the flow of water through the sink seal cap to the sink drain conduit. The waste plug, when removed from the drain cap, functions as a tool to remove the sink seal cap, thus the waste plug performing dual functions in the assembly.

7 Claims, 1 Drawing Sheet

SINK DRAIN ASSEMBLY INCLUDING SINK SEAL CAP REMOVAL TOOL

THE FIELD OF THE INVENTION

The present invention relates to sink drain assemblies which conventionally are used to control the flow of water out of a lavatory or kitchen sink. More particularly, the invention relates to such an assembly in which the visible and decorative portions of the assembly, the drain cap and the sink seal cap, may be simply removed and replaced by the homeowner. Such removal and replacement may be necessary if one of the elements in the drain assembly malfunctions or is broken or such removal may be needed when other plumbing fixtures associated with the sink, for example the faucet, are changed and the visible portions of the sink drain assembly should also be changed so that the decor is complementary. More specifically, the present invention provides a waste plug which is a part of the sink drain assembly, normally mounting the drain cap, which waste plug also functions as a removal tool for the sink seal cap.

SUMMARY OF THE INVENTION

The present invention relates to sink drain assemblies, and more particularly to a sink drain assembly in which the waste plug performs its conventional function, but is also a tool for removing the sink seal cap.

Another purpose of the invention is to provide a simply constructed reliable sink drain assembly including a drain cap, a sink seal cap, and a waste plug, which also functions as a removal tool.

Another purpose of the invention is to provide a sink drain assembly in which the visible and decorative portions thereof may be easily removed by the consumer.

Other purposes will appear in the ensuing specification, drawings and claims.

BRIEF DESCRIPTION OF THE DRAWINGS

The invention is illustrated diagrammatically in the following drawings wherein.

DESCRIPTION OF THE PREFERRED EMBODIMENT

The present invention relates to a sink drain assembly which includes the conventional three elements of a waste plug, a drain cap and a sink seal cap. The drain plug functions both in a conventional manner and as a removal tool for changing or replacing the sink seal cap. When the decor of a kitchen or bath is changed, that normally necessitates a new faucet, which may be different in finish from the previous faucet. It is customary to also change the sink seal cap and drain cap so that the finishes are compatible with the new faucet. The present invention, by providing a waste plug which also functions as a tool for removing the sink seal cap, allows the homeowner or consumer to make this change without the necessity of special tools or special training.

Figure 1:
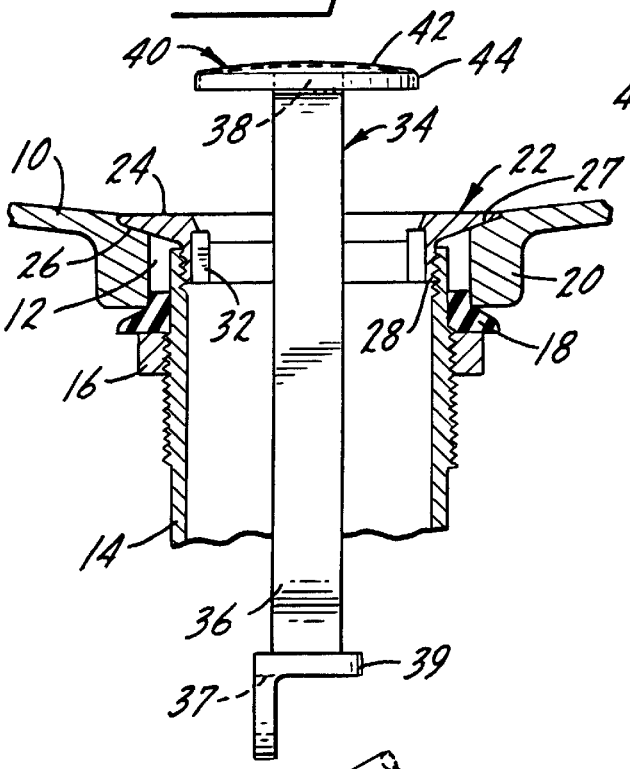
FIG. 1 is a side view, in part section, illustrating the sink drain assembly positioned within the sink.

In FIG. 1, a sink is indicated at 10 and may have a sink drain opening 12. A sink drain conduit 14 is attached to the sink by a nut 16 which is threaded on the exterior of the conduit 14 and presses a seal 18 against the bottom of the annular portion 20 of the sink 10 adjacent the opening 12.

The sink seal cap is indicated at 22 and has a top surface 24 and a lowered tapered wall 26 so that the cap may be located within a recess 27 in the sink 10 adjacent the opening 12. The sink seal cap 22 further has an annular depending wall 28 which is exteriorly threaded to mount the sink seal cap to the sink drain conduit 14.

Figure 4:
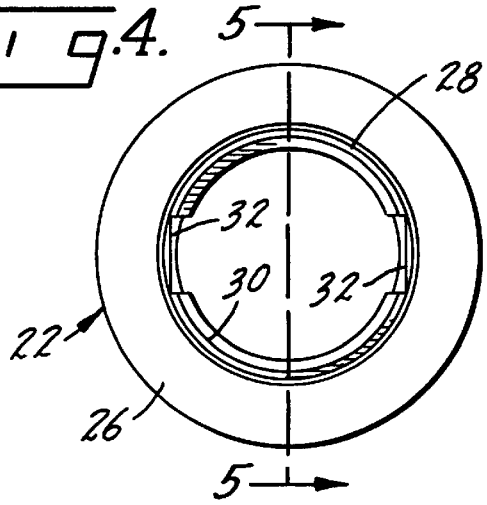
FIG. 4 is a bottom view of the sink seal cap.
Figure 5:
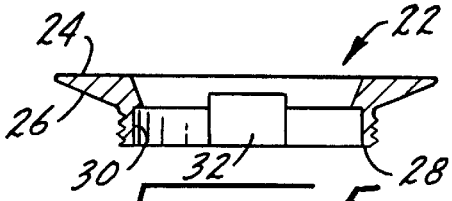
FIG. 5 is a section along plane 5—5 of FIG. 4.

As particularly shown in FIGS. 4 and 5, the sink seal cap has an annular interior groove 30 formed by the annular wall 28 and there are two diametrically opposed outwardly extending recesses 32 which open into the groove 30. These recesses form the basis for engagement with the waste plug.

The waste plug is indicated at 34 and may have a pair of flexible, bendable cantilever arms 36, each of which terminates at its free end, in outwardly curved projections 38. The width of the projections 38 is such that they may be received within and cooperate with the recesses 32, as particularly shown in FIG. 3. Thus, the arms 36 may be flexed inwardly to pass through the opening in the sink seal cap and then positioned within the recesses 32. Once so positioned, the drain plug functions as a removal tool to rotate the sink seal cap from its threaded connection with the sink drain conduit 14. To assist in such removal, a tool, such as a screwdriver 35, may be passed through a drain rod opening 37 in a bracket 39 forming a drain rod attachment.

Figure 2:
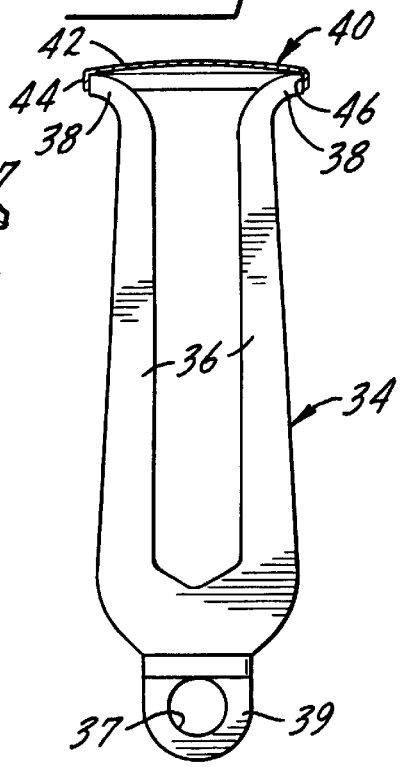
FIG. 2 is a side view of the waste plug and drain cap.

The drain cap is indicated at 40 and is the second visible decorative element in the sink drain assembly. The drain cap 40 has a top 42 and an annular depending wall 44 which defines an interior 46, formed and adapted to receive and cooperating with the free ends 38 of the drain plug arms 36 to attach the drain cap to the waste plug. This is particularly shown in FIG. 2. The normal function of the waste plug is to mount and hold the drain cap 40, with the waste plug bracket 39 at the junction of the arms 36, as particularly shown in FIGS. 2 and 3, connecting to a drain rod, not shown.

Figure 3:
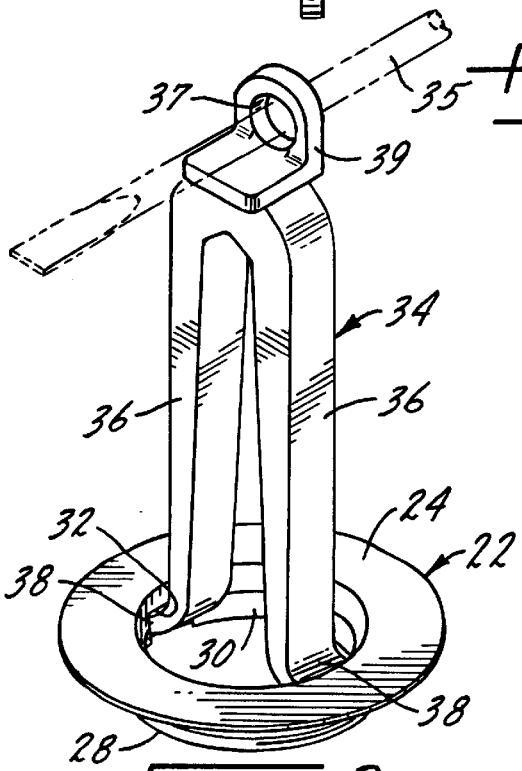
FIG. 3 is a perspective illustrating the mounting of the sink seal cap to the drain plug.

The waste plug 36 functions both as a removal tool, as indicated in FIG. 3, and in its normal capacity to raise and lower the drain cap. The raised position is shown in FIG. 1. Customarily, the drain cap, which closes the opening in the sink seal cap to allow the sink basin to be filled with water, is a visible, and thus decorative, element. The sink seal cap likewise is visible and its upper surface 24 may be considered to be decorative. When changing the plumbing fixtures associated with a sink, it is desirable to change both the sink seal cap and the drain cap so that these elements match the other plumbing fixtures mounted on the sink. To remove the tool 36 from the drain cap, the arms 36 are flexed inwardly allowing the cap to be removed and changed. The tool may then be used to remove the sink seal cap. Again, the arms 36 are flexed inwardly and they are positioned within the center open portion of the sink seal cap and located within the recesses 32. This may be done from above the sink, making sink seal cap removal very convenient. The tool may be rotated to remove the sink seal cap from the sink drain conduit. The new sink seal cap will be replaced in the reverse manner, after which the new drain cap may be mounted on the waste plug.

The waste plug is shown as having two flexible arms which permit interlocking with both the drain cap and sink seal cap. Other such means may be provided, for example, there may be a hex-shaped tool which has an end which interlocks with either or both the drain cap or sink seal cap. The arms 36 are described as being solid, but they may be hollow, in which case the drain plug would be fabricated, rather than cast or formed as a single element.

Whereas the preferred form of the invention has been shown and described herein, it should be realized that there may be many modifications, substitutions and alterations thereto.

The embodiments of the invention in which an exclusive property or privilege is claimed are defined as follows:

1. A sink drain assembly including a waste plug, a drain cap and a sink seal cap, said sink seal cap being formed and adapted to be attached to a sink drain conduit and to be mounted thereon in a sink drain opening, said waste plug and drain cap having cooperating means thereon whereby the drain cap may be removably mounted on the waste plug so that the combined waste plug and drain cap may function to control the flow of water through the sink seal cap to the sink drain conduit, said waste plug and sink seal cap having cooperating means thereon whereby the waste plug, with the drain cap removed therefrom, functions as a tool for removal of the sink seal cap from the sink drain conduit.

2. The assembly of claim 1 wherein the cooperating means on the waste plug for use with the drain cap and sink seal cap include flexible elements which, when bending pressure is applied thereto, move to disengage the drain cap or sink seal cap from the waste plug.

3. The assembly of claim 1 wherein the drain cap has a top surface and an annular wall depending therefrom, said waste plug having a pair of flexible arms with outwardly directed projections at free ends thereof, said outwardly directed projections extending within said drain cap annular wall to removably attach the waste plug to the drain cap.

4. The assembly of claim 3 wherein said flexible arms are joined at one end thereof, with said one end having a drain rod attachment thereon.

5. The assembly of claim 4 wherein said flexible arms are solid having a degree of flexure to permit removal from the inside of said drain cap.

6. The assembly of claim 1 wherein the sink seal cap has an interior groove and a pair of diametrically disposed outwardly extending recesses therein, said waste plug having a pair of flexible arms with outwardly directed projections at the free ends thereof, which projections are formed and adapted to be received within said outwardly directed recesses to removably attach the waste plug to the sink seal cap for removal of the sink seal cap from the sink drain conduit.

7. The assembly of claim 6 wherein said sink seal cap has an annular wall, threads on the exterior of said annular wall, with said threads being used to attach the sink seal cap to the sink drain conduit.

* * * * *